US006921228B2

(12) United States Patent
Williams et al.

(10) Patent No.: US 6,921,228 B2
(45) Date of Patent: Jul. 26, 2005

(54) IMPACT ABSORBING BARRIER

(75) Inventors: Tim Lee Williams, 2685 Corriher Grange Rd., Mt. Ulla, NC (US) 28125; Bret A. Conway, Denver, NC (US)

(73) Assignee: Tim Lee Williams, Mt. Ulla, NC (US)

( * ) Notice: Subject to any disclaimer, the term of this patent is extended or adjusted under 35 U.S.C. 154(b) by 0 days.

(21) Appl. No.: 10/390,291

(22) Filed: Mar. 17, 2003

(65) Prior Publication Data

US 2003/0210953 A1 Nov. 13, 2003

Related U.S. Application Data

(63) Continuation of application No. 09/713,362, filed on Nov. 15, 2000, now Pat. No. 6,533,495.

(51) Int. Cl.[7] ..... E01F 15/00
(52) U.S. Cl. ..... 404/6; 404/10
(58) Field of Search ..... 404/6, 10; 256/13.1

(56) References Cited

U.S. PATENT DOCUMENTS 5,314,261 A * 5/1994 Stephens ..... 404/6
5,746,419 A * 5/1998 McFadden et al. ..... 267/140
5,851,005 A * 12/1998 Muller et al. ..... 256/13.1
5,921,702 A * 7/1999 Fitch ..... 404/6
6,168,346 B1 * 1/2001 Ernsberger ..... 404/6
6,179,273 B1 * 1/2001 Edmunds et al. ..... 256/13.1
6,276,667 B1 * 8/2001 Arthur ..... 256/13.1
6,309,140 B1 * 10/2001 Kiedaisch et al. ..... 405/215
6,530,560 B2 * 3/2003 King ..... 256/1

* cited by examiner

*Primary Examiner*—Gary S. Hartmann
(74) *Attorney, Agent, or Firm*—Michael G. Johnston; Moore & Van Allen PLLC

(57) ABSTRACT

A deformable panel member is provided for absorbing the energy of a moving object impacting the panel member. The panel member is adapted to be connected to a rigid member and has a front wall, a rear wall and two side walls extending between and interconnecting the front and rear walls. A support member in panel member extends between and interconnects at least two of the walls. The side walls are adapted to be angled relative to the rigid member in a direction of movement of the object when the panel member is mounted to the rigid member. An impact on the panel member will tend to deform the panel member toward the rigid member in the direction of movement of the object. This deformation allows the panel member to absorb the energy of the object for decelerating and redirecting the object subsequent to impact. An energy absorbing barrier is also provided comprising a plurality of the panel members mounted at spaced intervals along the rigid member. The panel members are positioned in adjacent relation for allowing relative independent movement of the panel members upon impact. Impact of a panel member will transmit the force of the impact to adjacent panel members which are similarly deformed for successively absorbing energy and redirecting the object subsequent to impact at an angle relative to the rigid member less than the angle of impact.

26 Claims, 5 Drawing Sheets

IMPACT ABSORBING BARRIER

CROSS REFERENCE TO RELATED APPLICATION

This application is a continuation application of U.S. patent application Ser. No. 09/713,362, filed Nov. 15, 2000 now U.S. Pat. No. 6,533,495, the contents of which are incorporated herein by reference.

BACKGROUND

The present invention relates generally to a barrier for absorbing the energy of impact of a moving object and, more particularly, to an impact energy absorbing barrier for decelerating and redirecting a moving object, such as a vehicle, upon impact with the barrier.

Almost all automobile racetracks have a perimeter wall adjacent the track. Racetracks also typically have walls protecting areas of the infield, especially along pit road. The walls are designed primarily for the purpose of protecting spectators and other persons near the track. However, the walls present a danger to the drivers in the event of a wreck. For example, when a race car impacts against the wall, even at a shallow angle, the car is suddenly decelerated resulting in significant damage to the car and potentially serious and sometimes fatal injury to the driver. In addition, cars impacting the wall tend to rebound back into traffic on the racetrack where the cars may be struck by other race cars traveling at high speeds.

Similarly, barriers flank roadways or serve as a median barrier between adjacent roadways. The barriers are generally in the form of permanent installations, such as heavy concrete barriers or metal guardrails. Of course, damage to impacting vehicles and potential injury to occupants of the vehicles is substantial at high speed due to rapid deceleration and sharp redirection of the vehicles by the barriers. Some guardrails have been designed to yield under impact and produce a reduced resistance to advancement of the vehicle in a selected direction. However, repair and replacement of guardrails as a result of impact damage is expensive and time consuming.

For the foregoing reasons, there is a need for an impact absorbing barrier which absorbs the impact forces of a moving object, such as a vehicle, colliding with the barrier for decelerating the object. The impact absorbing barrier should be effective for use as a wall on a vehicle racetrack, or as a barrier installed on a roadway. Ideally, the new impact absorbing barrier will absorb and dissipate the energy of the impacting vehicle while also redirecting the vehicle along the barrier to prevent the rebound of the vehicle into traffic. The new barrier should suffer little or no damage due to impact, but in the event of damage be easy to install and repair. The barrier should also be of minimal depth to prevent loss of roadway or track surface area.

SUMMARY

Therefore, an object of the present invention is to provide an impact absorbing barrier which upon impact by a moving object, such as a vehicle, absorbs the impact energy for decelerating the vehicle.

Another object of the present invention is to provide an impact absorbing barrier which also redirects the vehicle at a low relative angle with the barrier.

A further object of the present invention is to provide an impact absorbing barrier which may be installed or replaced quickly and easily.

A still further object of the present invention is to provide an impact absorbing barrier which requires a small effective area for minimizing loss of roadway or track surface area.

According to the present invention, there is provided an apparatus adapted to be mounted to a rigid member for absorbing the energy of a moving object impacting the apparatus. The energy absorbing apparatus comprises a panel member formed of a deformable material. The panel member has a front wall, a rear wall and two side walls extending between and interconnecting the front and rear walls. The side walls are adapted to be angled relative to the rigid member in a direction of travel of the moving object when the panel member is mounted to the rigid member such that an impact on the panel member by the moving object will tend to deform the panel member toward the wall in the direction of movement of the object along the rigid member. This deformation allows the panel member to absorb the energy of the object for decelerating and redirecting the object subsequent to impact at a low angle relative to the rigid member. A support member is disposed in the cavity defined by the walls of the panel member and extends between and interconnects at least two of the walls for providing support to the panel member.

Also according to the present invention, an apparatus is provided to be mounted to a rigid member for absorbing the energy of a moving object impacting the apparatus. The energy absorbing apparatus comprises the above-described panel member and support member and means for mounting the panel member to the rigid member. In one embodiment, the mounting means comprises a mounting bracket having a front surface and a back surface and is adapted to be attached to the rigid member so that the rear surface abuts the rigid member. The front surface of the bracket has a plurality of longitudinal channels for receiving correspondingly-shaped ridges on the outer surface of the rear wall of the panel member for coupling the panel member to the bracket.

Further according to the present invention, a barrier is provided for absorbing the energy of a moving object impacting the barrier. The energy absorbing barrier comprises an elongated rigid member and a plurality of the above-described panel members, including support structure. Means are provided for mounting the panel members to the rigid member at spaced intervals extending longitudinally along the rigid member so that at least a portion of the rear wall of each of the panel members directly or indirectly abuts the rigid member and the panel members are positioned in adjacent relation for allowing relative independent movement of adjacent panel members upon impact. Impact of a panel member by the moving object will tend to deform the panel member toward the wall and in the direction of movement of the object along the rigid member for absorbing the energy and retarding movement of the object and for transmitting the force of the impact to adjacent panel members such that the adjacent panel members are similarly deformed for successively absorbing energy and redirecting the object subsequent to impact at an angle relative to the rigid member less than the angle of impact.

A feature of the deformable material of the panel member is the physical characteristics which allow the panel member to withstand the impact while absorbing the energy of the moving object, including a durometer of 70A and a Young's modulus of 5000 $lb_f/in$. These properties may be found in rubbers such as urethane and the like. The material may also be resilient so that the panel member returns to its original shape after impact by the moving object. The front wall of the panel member features an outer surface which is generally smooth and uniform. In one embodiment, compressible members fill the voids defined by the support member in the panel member cavity.

The energy absorbing panel member and barrier of the present invention is useful as a perimeter wall of an automobile racetrack or on a guardrail positioned adjacent a roadway. The barrier absorbs and dissipates the energy of a collision of a moving vehicle with a fixed surface while deflecting the vehicle safely along the fixed surface for reducing the potential injury to the driver of the vehicle and damage to the protected surface and the vehicle. Moreover, the barrier is designed to minimize installation time and maintenance. The mounting assembly has a minimal number of attachments which allows substantial portions of the barrier assembly to be removed and replaced quickly on the barrier in the event of damage. The impact absorbing barrier of the present invention provides an alternative to rigid perimeter walls on racetracks or other areas including inner walls, pits and other spectator participant areas.

BRIEF DESCRIPTION OF THE DRAWINGS

For a more complete understanding of the present invention reference should now be had to the embodiments shown in the accompanying drawings and described below. In the drawings.

DESCRIPTION

Certain terminology is used herein for convenience only. It is not to be taken as a limitation on the invention. For example, words such as "upper", "lower", "left", "right", "horizontal", "vertical", "upward", and "downward" merely describe the configurations shown in the Figures. Indeed, the components of the invention may be oriented in any direction in the terminology. Therefore, the present invention should be understood as encompassing such variations unless specified otherwise.

The term "wall" is used broadly herein to cover longitudinally extending fixed obstacles such as walls of various heights, as well as bridge piers, medians, guardrails and the like.

Figure 1:
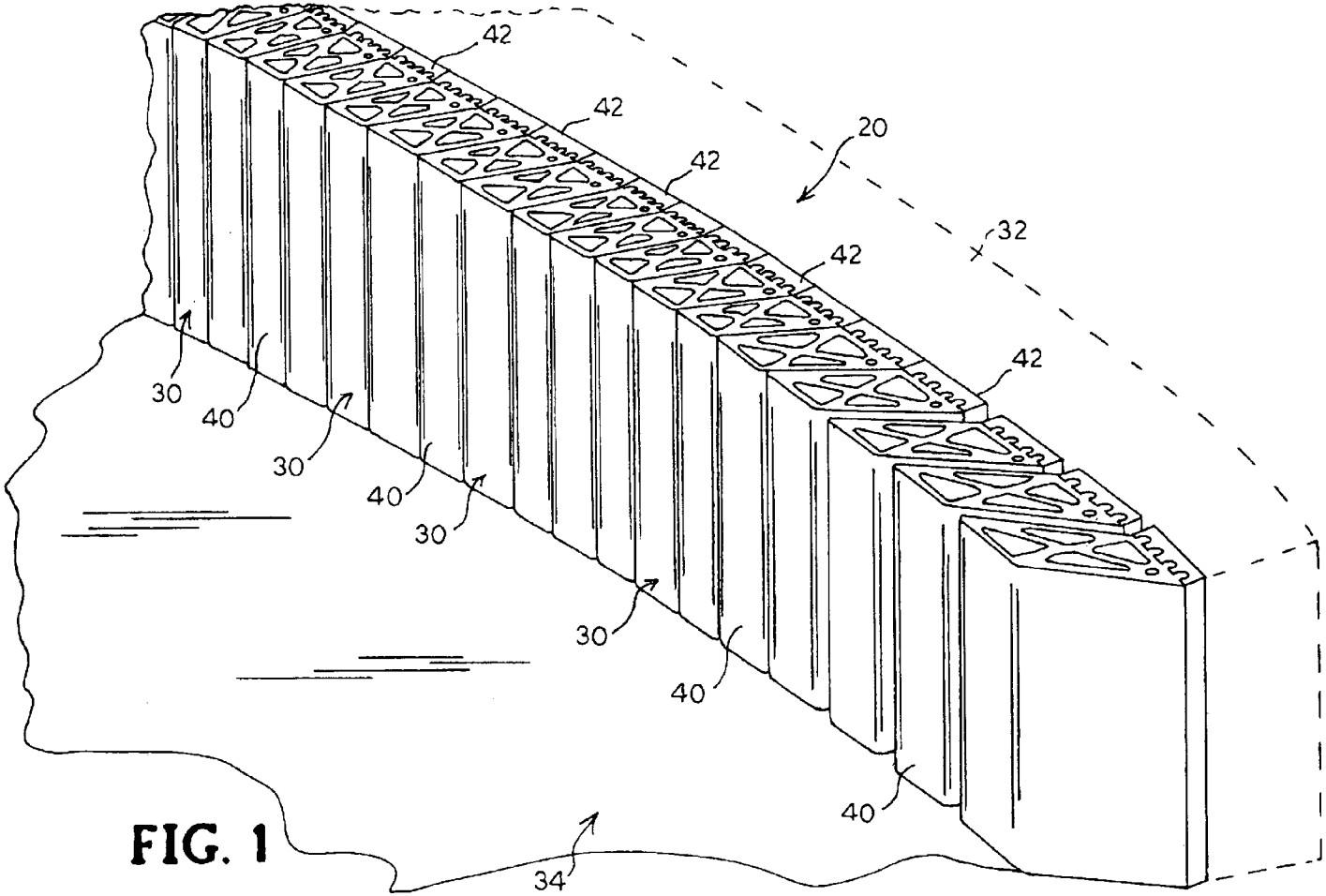
FIG. 1 is a perspective view of an impact absorbing barrier according to the present invention adjacent a racetrack or roadway.

Referring now to FIG. 1 there is shown a portion of an automobile racetrack or a roadway adjacent to which is mounted a barrier wall assembly constructed in accordance with the present invention and generally designated at 20. The barrier wall assembly 20 includes a plurality of energy absorbing structures 30 mounted to a rigid wall 32 such as, for example, the perimeter wall of the racetrack or a guard rail along the roadway 34. As will be described below, the energy absorbing structures 30 are deformable under impact by a moving vehicle for decelerating and redirecting the vehicle striking the barrier wall assembly 20.

Figure 2:
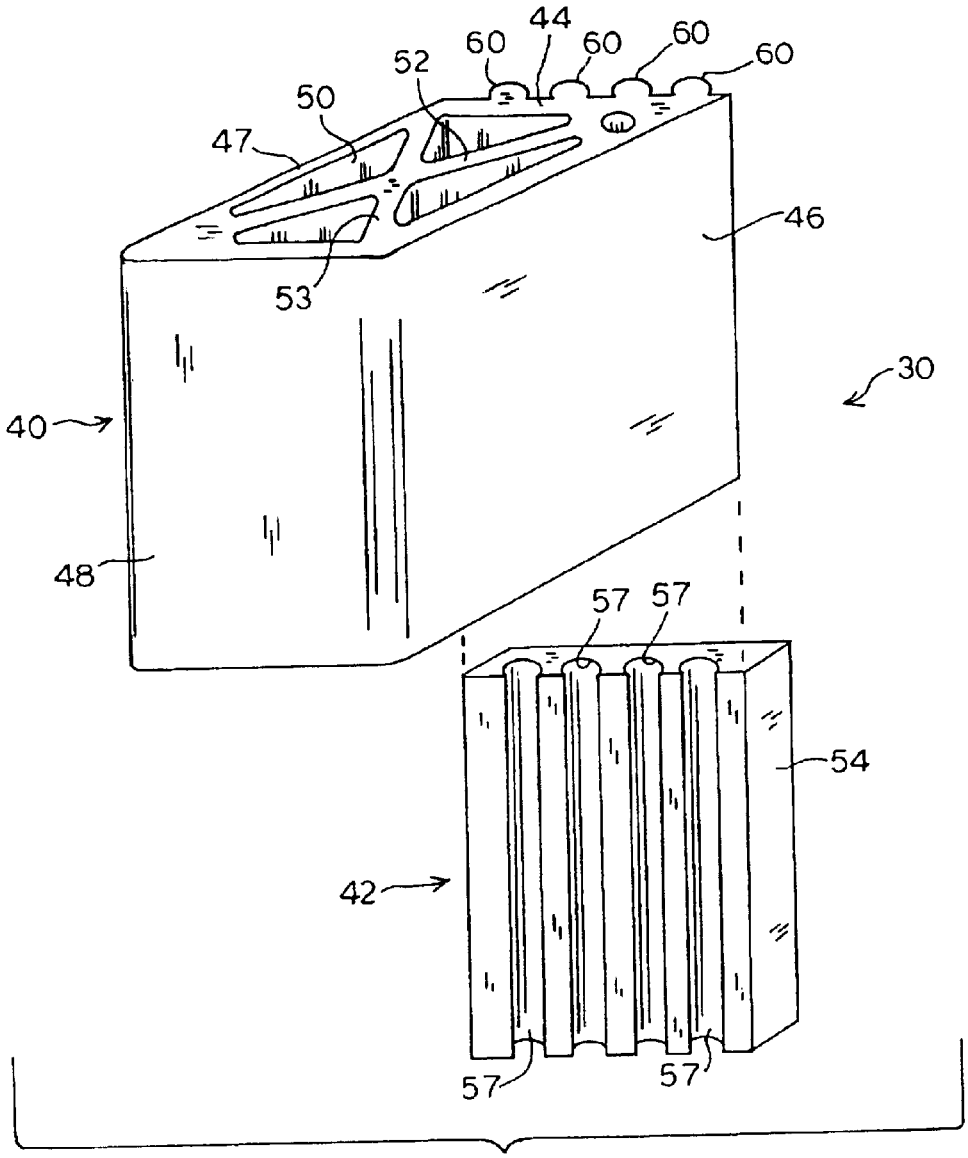
FIG. 2 is an exploded perspective view of an energy absorbing structure of the barrier as shown in FIG. 1.

An exploded view of an energy absorbing structure 30 is shown in FIG. 2. The energy absorbing structure 30 generally comprises a panel member 40 and a mounting assembly 42. The panel member 40 is trapezoidal, including a base wall 44, two side support walls 46, 47 which extend at an angle from the ends of the base wall 44, and a front wall 48 having an outer surface exposed to the roadway 34. The walls 44, 46, 47, 48 of the panel member 40 define a cavity 50. Support members 52, 53 span the cavity 50 from the ends of the base wall 44 to the ends of the front wall 48. The support members 52, 53 partition the cavity 50, in this case defining triangular voids using an "X" shape. It is understood that the support members may partition the cavity 50 in numerous ways thus defining voids of various shapes (See for example FIG. 4). The void space formed in the panel member 40 allows the panel member to deform upon impact for absorbing the kinetic energy of the impacting object. The voids may also be filled with compressible material such as open cell foam or the like for further energy absorbing potential.

The dimensions of the panel member 40 will be governed by the material of the panel member 40, racetrack or roadway 34 conditions and use, and the desired energy absorbing capacity of the barrier wall 20. For example, a panel member for use on a retaining wall adjacent stock car racetrack has the following characteristics:

| | |
|---|---|
| Durometer (shore hardness) | 70 A |
| Young's Modulus (100% elongation) | 5000 $lb_f/in^2$ |
| Poisson's Ratio | .3300 |
| Shear Modulus | 1880 $lb_f/in^2$ |
| Mass Density | 0.0041 $lb_m/in^3$ |
| Thermal Coefficient of Expansion | 0.00025 in/in/° F. |
| Allowable Stress | 8500 $lb_f/in^2$ |
| Max. Yield Stress | 8000 $lb_f/in^2$ |
| Thermal Conductivity | 0.00792 btu/sec*in* ° F. |
| Specific Heat | 0.229846 $btu/lb_m$* ° F. |

Preferably, the panel member 40 having these characteristics is made from rubber, and more preferably from urethane. The urethane panel member 40 may be extruded as one piece. The one-piece construction is stronger than a multi-piece component and simplifies installation and repair. Each wall 44, 46, 47, 48 of the panel member 40 formed from urethane for the stock racetrack application has a thickness of about 0.5 inches. Preferably, the panel members 40 accommodate as little space as possible beyond the face of the wall 32. A representative depth of the panel member 40 from the racetrack wall is about 12 inches and the front wall 48 is about 8 inches wide. The height of the panel member 40 may vary with the application and the position of the panel member 40 on the wall or other rigid member 32. The height and position of the panel members 40 is selected to provide an impacting vehicle of an average size with the least tendency for ramping or overturning. In the proper position, the panel members 40 provide vertical support to an impacting vehicle so there is no tendency for the vehicle to roll upon impacting the wall. This can be accomplished by raising the height of the center of the mass of the panel members 40. For example, an average passenger vehicle usually has a center of gravity of about 15 to about 25 inches above the ground which then determines the height of the panel members 40 to prevent ramping and rolling.

It is understood that suitable materials other than urethane may be used for the panel member 40, as long as the preferred physical characteristics are achieved. Such materials may include every kind of raw rubber, including vulcanized rubber, mixed rubber, and rubber mixed with other materials such as reinforcing particle rubber with carbon black as the reinforcing particle, reinforcing short fiber rubber, reinforcing long fiber rubber, cellular rubber and latex. Other materials that may be used include high molecular weight, high density polyethylene, synthetic plastic materials, resin impregnated materials, composites and the like.

The mounting assembly 42 comprises a substantially flat rectangular bracket 54 preferably formed of extruded aluminum. One side of the bracket 54 defines a plurality of longitudinal channels 57 which are nearly cylindrical in cross-section. The bracket 54 may be secured directly to the wall 32, as for example with threaded fasteners such as six or eight lag bolts (not shown). With simple fasteners for mounting the bracket 54, it is possible to easily replace a bracket damaged during impact with a new bracket 54.

Figure 3:
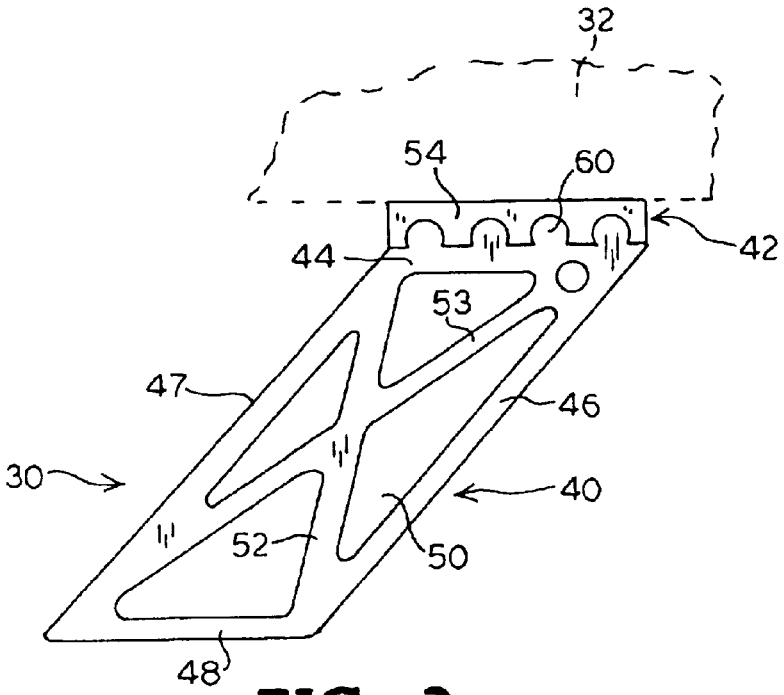
FIG. 3 is a top plan view of an energy absorbing structure shown in FIG. 2 mounted on a rigid member.

The outer surface of the base wall 44 has integral, longitudinal ridges 60. The ridges 60 also present a nearly cylindrical cross-section and are sized to correspond to the channels 57 in the bracket 54. Accordingly, the panel member 40 may be slid into the bracket 54 (FIG. 3) for coupling the panel member 40 to the mounting assembly 42. Other means of coupling the panel member 40 to the bracket 54 and wall 32 are possible. The goal of the coupling is to maximize the surface area of the panel member contacting the rigid member 32, directly or indirectly through the bracket 54, for distributing the impact force over the greatest possible area. However, the panel member 40 connection means should not tend to interfere with the energy absorbing capacity of the panel member 40 and the smooth redirection of an impacting vehicle along the length of the barrier assembly 20.

Figure 5:
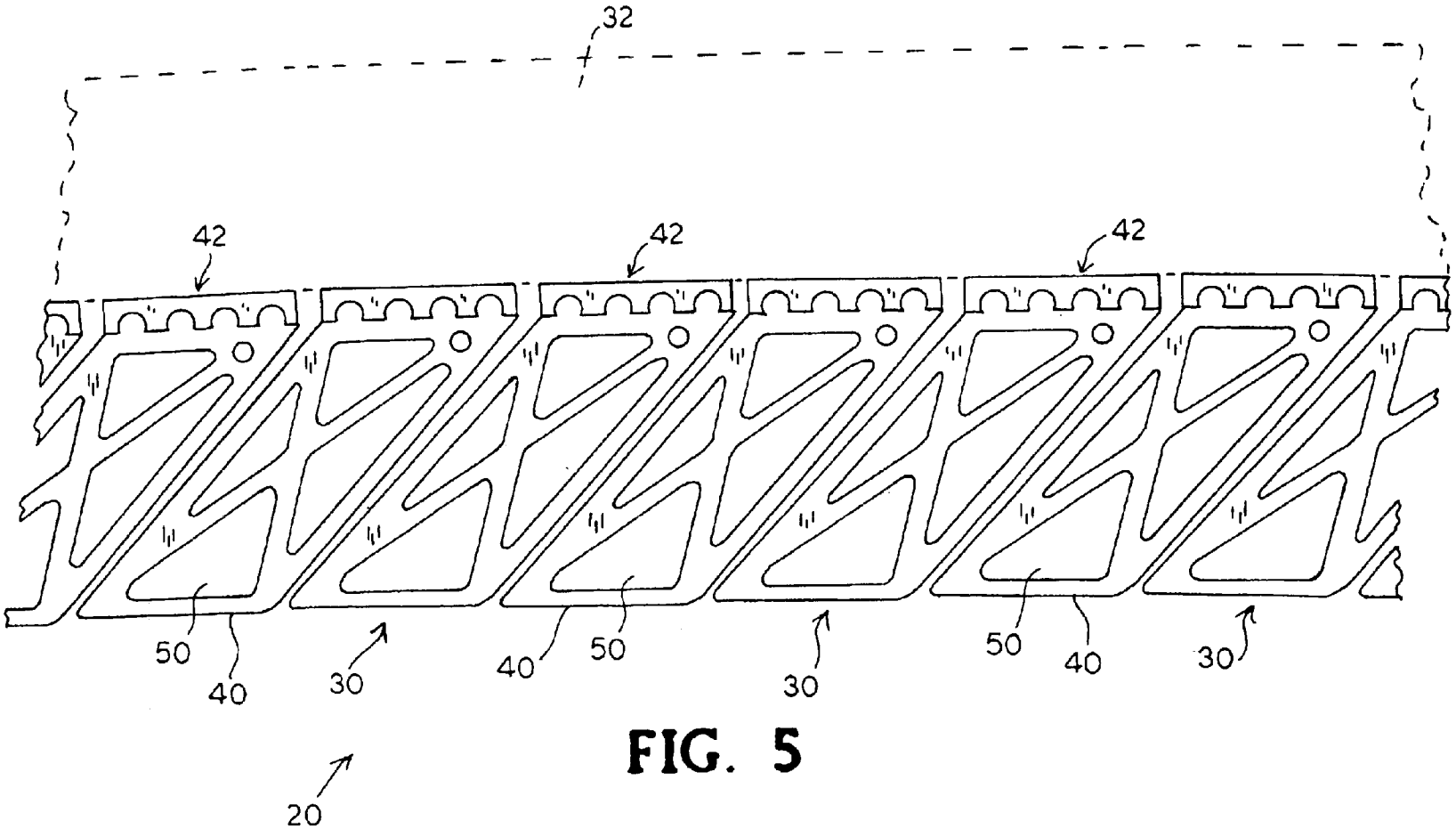
FIG. 5 is a top plan view of a barrier shown in FIG. 1.

In constructing the barrier wall 20, a plurality of brackets 54 of the mounting assembly 42 are attached to the wall 32 such that the channels 57 in the brackets 54 extend generally vertically. The brackets 54 are arranged in side-by-side spaced relation along the wall 32. As described above, the panel members 40 are then slid into the brackets 54 with the longitudinal ridges 60 received in the slots 57 in the brackets 54. The panel members 40 are thus suspended in place above the level of the roadway 34 adjacent to the wall 32. As seen in FIGS. 1 and 5, the brackets 54 are positioned so that when the panel members 40 are installed, the outer surface of the front wall 48 of the panel members 40 present a smooth surface and are substantially parallel, to the direction of traffic flow on the adjacent roadway 34. In addition, a space is left between the adjacent edges of the front walls 48 of succeeding panel members 40. This configuration prevents the front walls 48 from contacting one another and prevents snagging on impacting vehicles.

Figure 4:
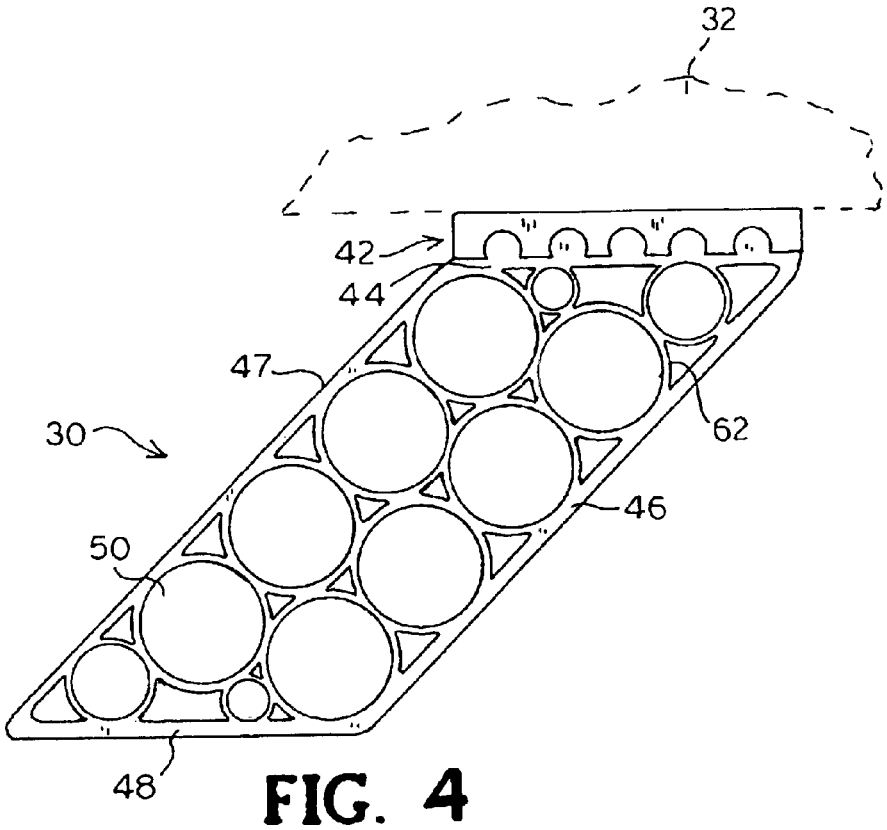
FIG. 4 is a top plan view of another embodiment of an energy absorbing structure according to the present invention.

Another embodiment of the panel member 40 according to the present invention is shown in FIG. 4. In this embodiment, the energy absorbing structure 30 includes tubular partitions 62 within the cavity 50 defined by the walls of the panel member 40. The tubular partitions 62 thus form the support structure in the panel member 40. The partitions 62 define one or more hollow cylinders extending vertically in the cavity. The panel member 40 of this embodiment may also be extruded as one piece. Alternatively, resilient tubular components 62 may be mounted individually in the cavity 50 and attached to the inner surface of the walls 44, 46, 47, 48 of the panel member by any suitable means such as adhesive, straps, bolts and the like. The tubular partitions 62 may also be extruded as one piece separate from the panel member 40 and only one of the tubes needs to be secured to the panel member for support. When attached by bolts, this arrangement preferably does not present any obstruction to be struck by an impacting vehicle. The wall thickness and size of the voids are selected based on the application. In a stock car racetrack application, the panel member material should have the same physical characteristics as listed above.

Referring to FIG. 1, vehicles that travel along the roadway 34 move in the direction of the arrow "A" which is therefore generally oriented in the anticipated direction of impact of a moving vehicle against the wall 34. When mounted on the wall or rigid member 32, the side walls 46, 47 of the panel member 40 form an angle with the wall. Preferably, the angle is about 25 degrees to about 60 degrees with the wall 32. At angles below about 25 degrees, the panel member 40 will not deform forwardly in the direction of travel of the moving object as efficiently as when a greater angle is used. Wall 46, 47 angles above 60 degrees result in a pulling effect on the panel member 40 upon impact, and straining on the mounting assembly, rather than flexure as a result of deformation of the panel member 40. The side support wall 46 of the first panel member 40 is angled in the direction of traffic. This configuration prevents impacting vehicles from snagging a forward end of the impact absorbing barrier wall 20.

Figure 6:
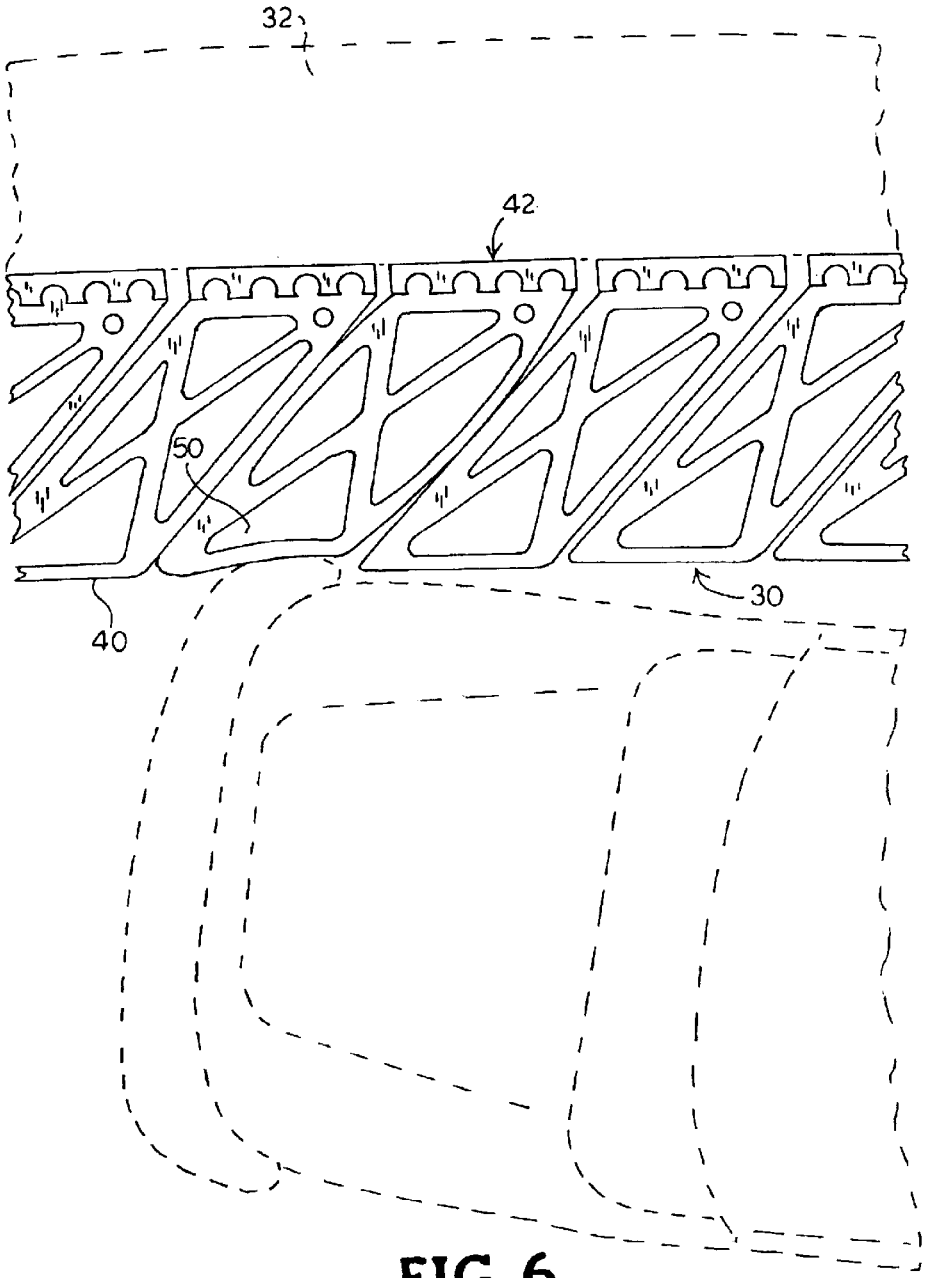
FIG. 6 is a barrier wall as shown in FIG. 1 being impacted by a moving vehicle.

Referring to FIG. 6, the outer surface of the front wall 48 of an impacted panel member 40 receives the initial impact force from a moving vehicle. As the vehicle impacts the panel member 40, the panel member bends generally inwardly and forwardly, in the direction of travel of the vehicle, towards the wall 32. The energy absorbing structure 30 is thus generally elastically deformed thereby dissipating the kinetic energy and decelerating the moving vehicle. As the panel member 40 absorbs the impact and continues to bend inwardly and forwardly toward the wall 32, the panel member will contact the next adjacent panel member 40 which, in turn, deforms to further absorb the impact energy of the vehicle. The panel members 40 assume the general configuration shown in FIG. 6. The impact force is thus transferred to each successive panel member 40 in the direction of travel of the vehicle as the impact event continues. The impact energy is thus effectively distributed between at least two panel members 40 at any point in time. The more panel members 40 involved in the impact event, the more energy absorbing capability. Since the panel members 40 are arranged to not contact one another prior to impact, each panel member 40 moves independently towards the wall 32 prior to contacting the adjoining panel member thus enabling the panel members to work together with subsequent panels so that the overall deceleration of the vehicle is achieved. In the racetrack example described above, the panel members 40 are capable of moving inward and forward to a depth of about 4 inches, or about two thirds of the initial depth of the panel member 40.

Because the operation of the panel members 40 allows each panel member to articulate with respect to each other, collapsing inwardly with a component of movement in the direction of travel of the impacting vehicle, the barrier wall 20 tends to redirect the impacting vehicle at a low angle of deflection relative to the direction of the impact, generally along the length of the barrier wall 20. The low coefficient of friction of the panel member surface enables the car to slide from panel member 40 to panel member further reducing any rebounding effect. This encourages the impacting vehicle to be gradually and smoothly redirected along the length of the barrier wall 20 and not returned to oncoming traffic. This reduces risk of further collision with other vehicles.

Thus, several details of the construction of the disclosed invention operate severally and jointly to absorb the impact energy of a moving vehicle and to properly deflect the vehicle from the barrier wall 20 at a very low angle. The barrier wall 20 redirects the vehicle sufficiently slowly thus preventing the vehicle from bouncing back into oncoming traffic adjacent the wall while minimizing damage to the vehicle and injury to the occupants. Ultimately, the vehicle is brought to rest clear of the racetrack or roadway 34.

The energy absorbing structures 30 are preferably self-restoring. When the impact event is over and the vehicle is moved away from a portion of the barrier wall 20, the resilient material of the panel member 40 allows the panel members 40 to move outwardly and return to their original configuration. Moreover, the energy absorbing structures 30 are not damaged in a typical impact. Even if one or more structures 30 are damaged, a panel member 40 or mounting assembly 42 can be quickly and easily replaced by simply removing the panel member from the slots 57 and replacing it with a new panel member.

The barrier wall assembly 20 described herein has been modeled to withstand a head on impact of a stock car vehicle weighing 3400 pounds at 188 mph. Under these conditions, 31,560 pounds of impulse force at impact will act on the driver. Assuming a driver weight of 180 pounds, the driver will experience 8.56 G's of force. The impulse force on the driver of a car impacting the barrier wall 20 of the present invention acting is 23,140 pounds. A 27% reduction over 0.0001 seconds. The driver will thus experience a force of 6.25 G's. The rate of reduction in velocity versus the contact velocity determines the force the driver will experience. The barrier wall 20 of the present invention reduces this rate by absorbing energy quickly.

The new barrier of the present invention has many advantages, including the ability to absorb and dissipate the energy of a collision of a moving vehicle with a fixed surface while deflecting the vehicle safely away from the fixed surface for reducing the potential injury to the driver of the vehicle and damage to the protected surface and the vehicle. Moreover, the barrier is designed to minimize installation time and maintenance. The mounting assembly has a minimal number of attachments which allows substantial portions of the barrier assembly to be removed and replaced quickly on the barrier in the event of damage. The impact absorbing barrier of the present invention provides an alternative to rigid perimeter walls on racetracks lined or other areas including inner walls, pits and other spectator participant areas. The barrier also is useful on roadways in place of guardrails or in median strips.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, the panel member and barrier may be used under any circumstance where the energy of a moving member must be absorbed upon impact with the panel member or barrier. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a crew may be equivalent structures.

What is claimed is:

1. A deformable panel member adapted to be mounted to a fixed surface for absorbing the energy of a moving object impacting the panel member, the deformable panel member comprising:

a front wall;

a base wall, at least a portion of the base wall being adapted to abut the fixed surface when the panel member is mounted to the fixed surface;

a first side wall and a second side wall extending between and interconnecting the front wall and base wall whereby a cavity is defined in the panel member by the inner surfaces of the front, base and side walls, the first and second side walls extending from the base wall such that the inner surface of the first side wall and the inner surface of the base wall define an acute angle and the inner surface of the second side wall and the inner surface of the base wall define an obtuse angle, wherein an edge of at least one of the first side wall or the second side wall interconnects at an edge of the front wall; and a support wall disposed in the cavity and extending between and merging integrally with at least two of the front, base, and side walls for providing support to the panel member, such that the force of impact of the moving object on the panel member tends to deform the panel member whereby the front wall of the panel member is displaced, the first side wall is elongated, and the second side wall is compressed relative to the base wall.

2. A deformable panel member as recited in claim 1, wherein the panel member is formed from a resilient material so that the panel member returns to its original shape after impact by the moving object.

3. A deformable panel member as recited in claim 1, wherein the panel member defines a quadrilateral in cross-section.

4. A deformable panel member as recited in claim 1, wherein the panel member defines a trapezoid in cross-section.

5. A deformable panel member as recited in claim 4, wherein the front wall and base wall are parallel.

6. A deformable panel member as recited in claim 4, wherein the first side wall and the second side wall are parallel.

7. A deformable panel member as recited in claim 1, wherein the panel member defines a parallelogram in cross-section.

8. A deformable panel member as recited in claim 1, wherein the edge of the first side wall interconnects at the edge of the front wall.

9. A deformable panel member as recited in claim 1, further comprising a second support wall, each of the support walls diagonally spanning the cavity and merging integrally with the junctions of the side walls with the front wall and base wall, the support walls integrally joined intermediate their ends.

10. A deformable panel member as recited in claim 9, wherein the support walls divide the cavity into four voids having triangular cross-sections.

11. A deformable panel member as recited in claim 1, further comprising a plurality of support walls disposed in the cavity and extending between and merging integrally with the front, base, and side walls wherein a plurality of voids are defined in the panel member.

12. A deformable panel member as recited in claim 11, wherein the voids are generally circular in cross-section.

13. A deformable panel member as recited in claim 1, wherein the acute angle is from about 25 to about 60 degrees and the obtuse angle is from about 120 to about 155 degrees.

14. A deformable panel member as recited in claim 1, wherein the edge of the second side wall interconnects at the edge of the front wall.

15. A deformable panel member as recited in claim 1, wherein the edge of the first side wall interconnects at an edge of the base wall.

16. A deformable panel member as recited in claim 1, wherein the edge of the second side wall interconnects at an edge of the base wall.

17. A deformable panel member as recited in claim 1, wherein the edges of the first side wall and the second side wall interconnect at the edges of the front wall.

18. A deformable panel as recited in claim 1, wherein the panel member is formed from a raw rubber selected from the group consisting of vulcanized rubber, mixed rubber, a reinforced particle rubber, and a combination thereof.

19. A panel member created from the rubber as recited in claim 18, wherein the reinforced particle rubber is selected from the group consisting of reinforced short fiber rubber, reinforced long fiber rubber, cellular rubber, latex, and a combination thereof.

20. A panel member created from the rubber as recited in claim 18, wherein the reinforced particle rubber is reinforced with carbon black.

21. A deformable panel member as recited in claim 1, wherein the acute angle is at least about 25 degrees.

22. A deformable panel member as recited in claim 1, wherein the acute angle is up to about 60 degrees.

23. A deformable panel member as recited in claim 1, wherein the acute angle is at least about 25 degrees to about 60 degrees.

24. A deformable panel member as recited in claim 1, wherein the obtuse angle is at least about 120 degrees.

25. A deformable panel member as recited in claim 1, wherein the obtuse angle is up to about 155 degrees.

26. A deformable panel member as recited in claim 1, wherein the obtuse angle is at least about 120 degrees to about 155 degrees.

* * * * *